US009976771B2

(12) United States Patent
Chen et al.

(10) Patent No.: US 9,976,771 B2
(45) Date of Patent: May 22, 2018

(54) APPARATUS AND METHODS FOR DELIVERING A HEATED FLUID

(71) Applicant: 3M INNOVATIVE PROPERTIES COMPANY, St. Paul, MN (US)

(72) Inventors: Andrew W. Chen, Woodbury, MN (US); Andrew R. Fox, Oakdale, MN (US); Scott A. Jerde, Maplewood, MN (US); William P. Klinzing, West Lakeland, MN (US); Bradley K. Kucera, Lakeville, MN (US); Patrick J. Sager, Hastings, MN (US); James C. Breister, Oakdale, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 1041 days.

(21) Appl. No.: 14/257,253

(22) Filed: Apr. 21, 2014

(65) Prior Publication Data

US 2014/0226961 A1 Aug. 14, 2014

Related U.S. Application Data

(62) Division of application No. 12/948,094, filed on Nov. 17, 2010, now Pat. No. 8,744,251.

(51) Int. Cl.
*F24H 1/10* (2006.01)
*F24H 9/12* (2006.01)
(Continued)

(52) U.S. Cl.
CPC ..... *F24H 1/102* (2013.01); *D04H 1/54* (2013.01); *D04H 3/08* (2013.01); *D04H 3/14* (2013.01);
(Continued)

(58) Field of Classification Search
CPC ..... B67D 7/80; F24H 9/2028; F24H 1/102; F24H 9/0021; F24H 9/128; H05B 3/82
(Continued)

(56) References Cited

U.S. PATENT DOCUMENTS 4,098,073 A 7/1978 Adkins
4,674,197 A 6/1987 Fleissner
(Continued)

FOREIGN PATENT DOCUMENTS

EP 1 834 699 9/2007
GB 652 545 A 4/1951
(Continued)

OTHER PUBLICATIONS

Sahin, B. and Ward-Smith, A.J.; "The use of perforated plates to control the flow emerging from a wide-angle diffuser, with application to electrostatic precipitator design"; Heat and Fluid Flow; vol. 8, No. 2 (Jun. 1987), pp. 124-131.
(Continued)

*Primary Examiner* — Dana Ross
*Assistant Examiner* — James Sims, III
(74) *Attorney, Agent, or Firm* — Kenneth B. Wood

(57) ABSTRACT

Apparatus and methods for delivering a heated fluid. The apparatus includes at least a preheat zone, an expansion zone, and an expanded zone comprising a plurality of trim heaters, at least one fluid flow-distribution sheet, and an outlet. The apparatus may be used for delivering the heated fluid onto a moving fluid-permeable substrate.

17 Claims, 5 Drawing Sheets

(51) Int. Cl.

| | |
|---|---|
| ***F24H 9/00*** | (2006.01) |
| ***F24H 9/20*** | (2006.01) |
| ***D04H 1/54*** | (2012.01) |
| ***D04H 3/14*** | (2012.01) |
| ***D04H 3/16*** | (2006.01) |
| ***D04H 3/08*** | (2006.01) |
| ***D06C 7/00*** | (2006.01) |
| ***F26B 13/10*** | (2006.01) |

(52) U.S. Cl.
CPC ..... *D04H 3/16* (2013.01); *D06C 7/00* (2013.01); *F24H 9/0021* (2013.01); *F24H 9/128* (2013.01); *F24H 9/2028* (2013.01); *F26B 13/108* (2013.01)

(58) Field of Classification Search
USPC ..... 392/349–352, 381, 465, 466, 473, 474, 392/478–480, 485, 490, 491; 222/146.2, 222/146.3, 146.4, 146.5
See application file for complete search history.

(56) References Cited

U.S. PATENT DOCUMENTS

| | | | | |
|---|---|---|---|---|
| 4,692,592 | A | 9/1987 | Kale | |
| 5,167,745 | A | 12/1992 | Governale | |
| 5,227,175 | A | 7/1993 | Reinbold | |
| 5,259,124 | A | 11/1993 | Poterala | |
| 5,510,194 | A | 4/1996 | Hendricks | |
| 5,579,704 | A | 12/1996 | Mansur | |
| 5,707,468 | A | 1/1998 | Arnold | |
| 5,913,997 | A | 6/1999 | Schulz et al. | |
| 5,946,901 | A | 9/1999 | Bauver | |
| 5,976,256 | A | 11/1999 | Kawano | |
| 6,019,152 | A | 2/2000 | Haynes | |
| 6,066,221 | A | 5/2000 | Marmon | |
| 6,647,204 | B1 * | 11/2003 | Hutchinson | A47L 11/34 15/320 |
| 8,260,126 | B2 * | 9/2012 | Lord | F24H 1/225 392/465 |
| 2003/0192737 | A1 | 10/2003 | Han | |
| 2005/0186351 | A1 | 8/2005 | Fung | |
| 2007/0137563 | A1 * | 6/2007 | Schweizer | B05C 5/005 118/411 |
| 2007/0190261 | A1 * | 8/2007 | Darnell | B05B 13/0207 427/424 |
| 2008/0038976 | A1 | 2/2008 | Berrigan | |
| 2008/0041305 | A1 | 2/2008 | Pekurovsky | |
| 2009/0071561 | A1 | 3/2009 | Dalrymple | |
| 2010/0086289 | A1 | 4/2010 | Johnson | |

FOREIGN PATENT DOCUMENTS

| | | | |
|---|---|---|---|
| GB | 1 191 536 | A | 5/1970 |
| JP | 2003-050032 | A | 2/2003 |
| JP | 2004-347220 | A | 12/2004 |
| JP | 2009-281723 | A | 12/2009 |
| JP | 2010-529394 | A | 8/2010 |
| WO | WO 2008/103372 | A2 | 8/2008 |

OTHER PUBLICATIONS

Sahin, B. and Ward-Smith, A.J.; "Effect of Perforated Plates on Wide-angle Diffuser-Exit Velocity Profiles", Journal of Wind Engineering and Industrial Aerodynamics; vol. 34 (1990), pp. 113-125.
International Search Report, PCT/US2011/060783, dated May 5, 2012, 3 pages.
Extended European Search Report, EP11842323.5, dated Mar. 17, 2017, 3 pages.

* cited by examiner

APPARATUS AND METHODS FOR DELIVERING A HEATED FLUID

BACKGROUND

Heated fluids are often delivered to substrates, e.g. moving web-like substrates, for a variety of purposes. For example, heated fluids may be impinged upon a substrate for purposes of bonding, annealing, drying, promoting a chemical reaction, and the like.

SUMMARY

Herein are disclosed apparatus and methods for delivering a heated fluid. The apparatus comprises at least a preheat zone, an expansion zone, and an expanded zone comprising a plurality of trim heaters, at least one fluid flow-distribution sheet, and an outlet.

Thus in one aspect, herein is disclosed an apparatus for handling, heating and delivering a fluid, comprising: a preheat zone comprising a preheater; an expansion zone fluidly connected to the preheat zone; an expanded zone fluidly connected to the expansion zone and comprising a downstream axis and a lateral extent and a tertiary extent, the expanded zone further comprising: a plurality of trim heaters collectively extending across at least a portion of the lateral extent of the expanded zone, at least one fluid flow-distribution sheet, and, an outlet.

Thus in another aspect, herein is disclosed a method of passing a heated fluid through a moving, fluid-permeable substrate, comprising: preheating a fluid; passing the preheated fluid through an expansion zone; passing the preheated fluid through an expanded zone, exposing at least a portion of the preheated fluid to at least one of a plurality of trim heaters within the expanded zone, passing at least a portion of the preheated fluid through at least one fluid flow-distribution sheet within the expanded zone; and, passing the preheated fluid through an outlet of the expanded zone onto the moving, fluid-permeable substrate and passing it through the substrate; and, capturing and removing at least a portion of the fluid passed through the substrate, by a fluid-suction apparatus located on the opposite side of the substrate from the outlet.

These and other aspects of the invention will be apparent from the detailed description below. In no event, however, should the above summaries be construed as limitations on the claimed subject matter, which subject matter is defined solely by the attached claims, as may be amended during prosecution.

Like reference numbers in the various figures indicate like elements. Some elements may be present in identical or equivalent multiples; in such cases only one or more representative elements may be designated by a reference number but it will be understood that such reference numbers apply to all such identical elements. Unless otherwise indicated, all figures and drawings in this document are not to scale and are chosen for the purpose of illustrating different embodiments of the invention. In particular the dimensions of the various components are depicted in illustrative terms only, and no relationship between the dimensions of the various components should be inferred from the drawings, unless so indicated. Although terms such as "top", "bottom", "upper", "lower", "under", "over", "front", "back", "outward", "inward", "up" and "down", and "first" and "second" may be used in this disclosure, it should be understood that those terms are used in their relative sense only unless otherwise noted.

DETAILED DESCRIPTION

Figure 1:
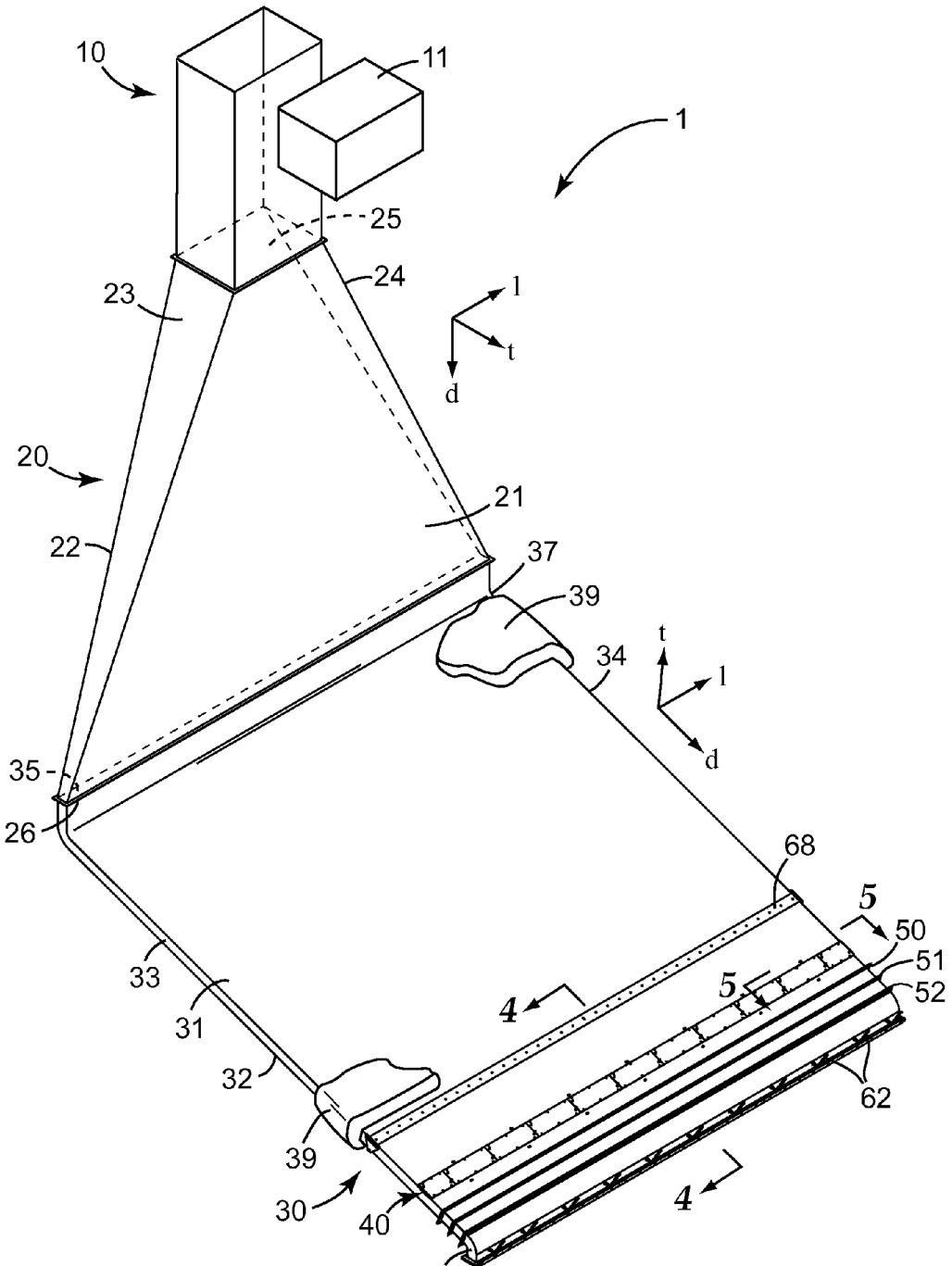
FIG. 1 is a front-side perspective view of an exemplary apparatus as disclosed herein.
Figure 2:
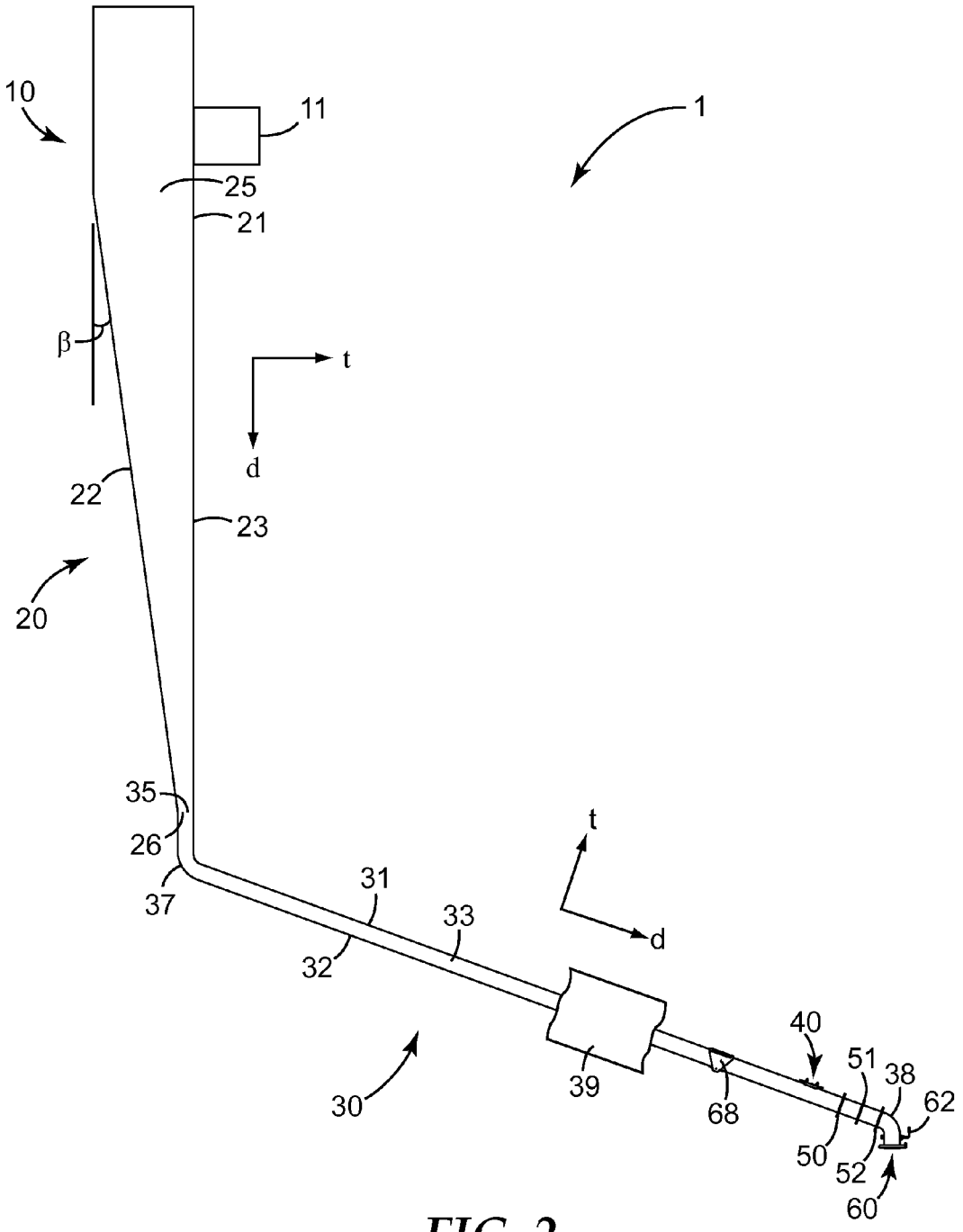
FIG. 2 is a side view of the exemplary apparatus of FIG. 1.

Shown in FIG. 1 in side perspective view, and in FIG. 2 in side view, is an exemplary apparatus 1 which may be used to deliver a heated fluid. Apparatus 1 is a fluid heating and handling apparatus that comprises several zones (units) that are defined at least by major walls and that are fluidly connected to each other as disclosed herein. The various zones of apparatus 1 will be described herein with respect to the downstream, lateral, and tertiary axis of each zone. For each zone, the downstream axis "d" is the axis generally aligned with the overall flow of fluid through that zone, as shown in FIG. 1. The downstream direction is the direction of overall fluid flow along this axis; the upstream direction is the opposite direction along the same axis. At any point in a zone, the lateral axis "l" is the longest axis that is orthogonal to downstream axis "d" of that zone. For example, the lateral extent of expansion zone 20 at any particular point along the downstream axis "d" of expansion zone 20 will be the distance between minor walls 23 and 24 along a line passing through that point of the downstream axis. Similarly, the lateral extent of expanded zone 30 at any particular point along the downstream axis of expanded zone 30 will be the distance between minor walls 33 and 34 along a line passing through that point of the downstream axis of expanded zone 30.

For each zone, the tertiary axis "t" is the shortest axis that is orthogonal to downstream axis "d" of that zone (and will also be orthogonal to lateral axis "l" of that zone). For example, the tertiary extent of expansion zone 20 at any particular point along the downstream axis of expansion zone 20 will be the distance between major walls 21 and 22 along a line passing through that point of the downstream axis. Similarly, the tertiary extent of expanded zone 30 at any particular point along the downstream axis of expanded zone 30 will be the distance between major walls 31 and 32 along a line passing through that point of the downstream axis of expanded zone 30. The terms tertiary axis and tertiary extent are used herein for convenience in distinguishing them from the lateral axis or extent, and does not signify or require that the tertiary axis of a particular zone of apparatus 1 is necessarily aligned with the Earth's gravity. And, as is evident from FIG. 1, the downstream, lateral and/or tertiary axis of a particular zone of apparatus 1 may not be aligned with that of another zone of apparatus 1.

Figure 3:
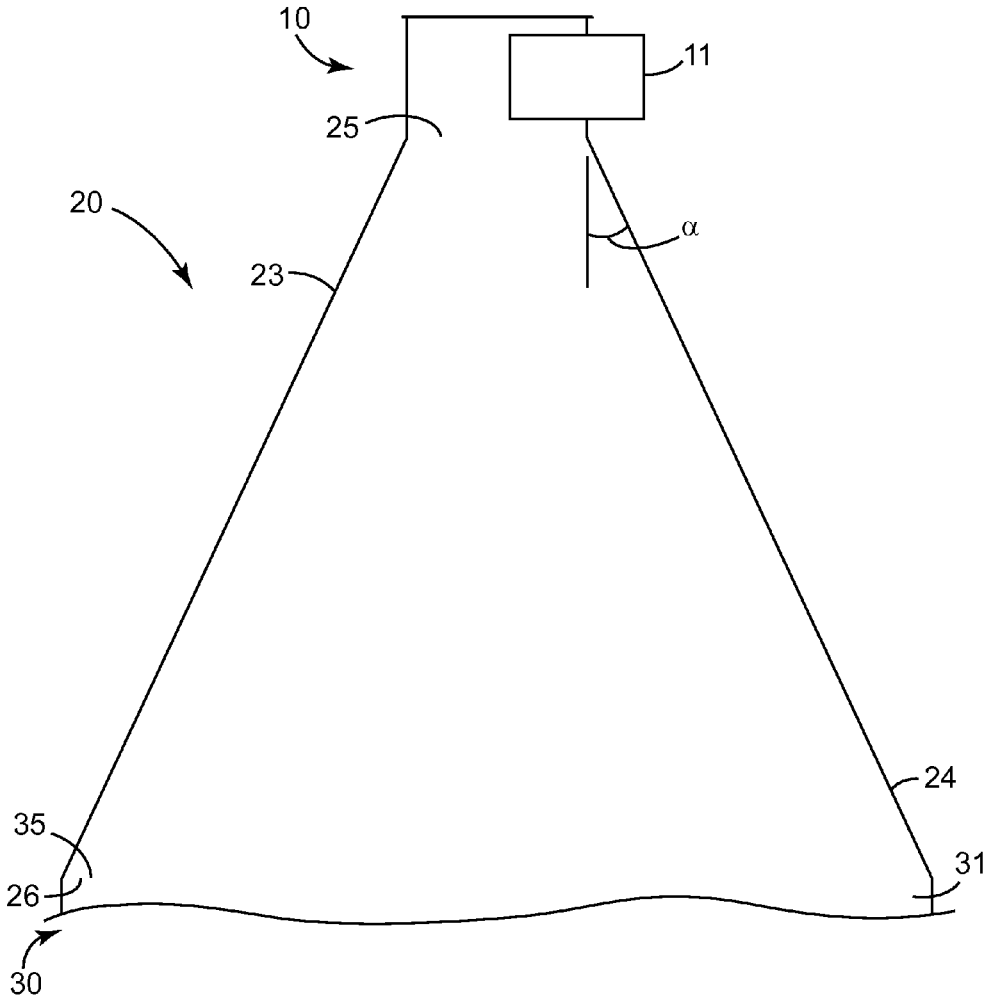
FIG. 3 is a front view of a portion of the exemplary apparatus of FIG. 1.

Apparatus 1 comprises a preheat zone 10 which comprises an inlet configured to receive a stream of fluid (e.g., air, as motivated by a blower) and which comprises one or more preheaters 11 (shown in idealized representation in FIGS. 1-3). Preheat zone 10 is shown in FIG. 1 as generally rectangular in cross section, but may be oval, circular, and so on. (In the particular case of a circular cross section, there may be no distinction between the lateral and tertiary axes of preheat zone 10). Preheater 11 may comprise any suitable heat source that may heat the fluid passing through preheat zone 10 by any suitable method, including e.g. radiant heat, direction injection of superheated steam, direct combustion, and so on. Often, it may be convenient for preheater 11 to comprise a heat exchange unit that transfers thermal energy from a preheating fluid (e.g., steam, combustion gases, etc.), into the fluid to be heated. Fluid that exits preheat zone 10 is referred to herein as preheated fluid and may be subjected to an additional heating step referred to as a trim heating step and described in detail later herein. Preheater 11 may preheat the fluid to a nominal temperature but some variation (e.g., in the range of plus or minus 1, 3, 7, or more degrees C.) may exist in the temperature of the preheated fluid. Such variations in the temperature of the preheated fluid may occur in particular over the lateral extent of the below-discussed expansion zone (and so in some cases may thus be caused primarily by flow behavior in the expansion zone, as discussed later herein, rather than by any nonuniformity in the heating accomplished by preheater 11). Such temperature variations, regardless of their cause, may be compensated for (that is, the fluid temperature may be finely controlled) by the trim heaters disclosed later herein.

Apparatus 1 further comprises an expansion zone 20 that is fluidly connected to preheat zone 10 in order to receive preheated fluid therefrom. The exemplary expansion zone 20 depicted in FIGS. 1, 2 and 3 comprises first major wall 21, second major wall 22, and first and second minor walls 23 and 24. Expansion zone 20 comprises a downstream axis as described above and at any point along the downstream axis will comprise a lateral extent measureable along a lateral axis, and a tertiary extent measureable along a tertiary axis.

Expansion zone 20 comprises inlet 25 through which preheated fluid is received from preheat zone 10. Inlet 25 comprises a lateral extent and a tertiary extent and a cross sectional area. Expansion zone 20 comprises outlet 26 through which preheated fluid exits expansion zone 20. Outlet 26 comprises a lateral extent and a tertiary extent and a cross sectional area. As can be seen in FIG. 1 and in particular in FIG. 3 (which presents a front view of expansion zone 20), significant lateral expansion may occur in progressing downstream from inlet 25 to outlet 26. In various embodiments, expansion zone 20 comprises a lateral expansion factor (defined as the lateral extent of expansion zone 20 at outlet 26, divided by the lateral extent of expansion zone 20 at inlet 25) of at least about 2.5, at least about 3.5, or at least about 4.5. This lateral expansion can be further characterized in terms of lateral expansion angle $\alpha$ (as shown in FIG. 3), which is the angle at which a minor side wall of expansion zone 20 deviates from the downstream axis of expansion zone 20. In various embodiments, lateral expansion angle $\alpha$ is at least about 15, at least about 20, or at least about 24 degrees. It may often be convenient for the lateral expansion to be symmetric (as in FIGS. 1 and 3), but other arrangements are possible.

As can be seen in FIG. 1 and in particular in FIG. 2 (in which expansion zone 20 is visible in side view), significant tertiary contraction may occur in progressing downstream from inlet 25 to outlet 26. In various embodiments, expansion zone 20 comprises a tertiary contraction factor (defined as the tertiary extent of expansion zone 20 at inlet 25, divided by the tertiary extent of expansion zone 20 at outlet 26) of at least about 4.0, at least about 5.0, or at least about 6.0. This tertiary contraction can be further characterized in terms of tertiary contraction angle $\beta$ (as shown in FIG. 2), which is the angle at which a major wall (e.g., wall 22 of FIG. 2) of expansion zone 20 deviates from the downstream axis of expansion zone 20. In various embodiments, tertiary contraction angle $\beta$ is at least about 4.0, at least about 6.0, or at least about 8.0 degrees. It will be recognized that the characterization in terms of angle $\beta$ is applicable to the particular exemplary embodiment of FIG. 2, which is an asymmetric design in which one major side wall (wall 21) of expansion zone 20 is generally aligned with the downstream axis while the other (wall 22) deviates from the downstream axis to provide the tertiary contraction. It is also possible to have both side walls deviate from the downstream axis, in which case the contraction can be characterized in terms of an angle exhibited by each major side wall. In such case, in various embodiments such angles can be at least about 2.0, at least about 3.0, or at least about 4.0 degrees.

The above-described significant lateral expansion combined with the significant tertiary contraction provide outlet 26 of expansion zone 20 with a high aspect ratio, meaning the ratio of the lateral extent of outlet 26 to the tertiary extent of outlet 26. In various embodiments, the aspect ratio of outlet 26 of expansion zone 20 may be at least about 25:1, at least about 35:1, or at least about 45:1.

In various exemplary embodiments, expansion zone 20 may comprise a lateral extent at inlet 25 of at most about 80 inches (203 cm), at most about 50 inches (127 cm), or at most about 31 inches (79 cm). In further exemplary embodiments, expansion zone 20 may comprise a lateral extent at outlet 26 of at least about 90 inches (229 cm), at least about 120 inches (305 cm), or at least about 140 inches (356 cm). In various exemplary embodiments, expansion zone 20 may comprise a tertiary extent at inlet 25 of at least about 10 inches (25 cm), at least about 15 inches (38 cm), or at least about 19 inches (48 cm). In further embodiments, expansion zone 20 may comprise a tertiary extent at outlet 26 of at most about 6.0 inches (15 cm), at most about 5.0 inches (13 cm), at most about 4.0 inches (10 cm), or at most about 3.0 inches (7.6 cm). In various exemplary embodiments, the cross sectional area of inlet 25 may be greater than that of outlet 26, by a factor of at least about 1.1, at least about 1.2, or at least about 1.3. It will be appreciated that the above numerical values are merely exemplary illustrations, and that the particular design of apparatus 1 may be varied as desired. For example, the angle of lateral expansion and/or tertiary contraction may not be constant (that is, major walls 21 and/or 22; and/or minor walls 23 and/or 24, may be arcuate rather than generally planar as illustrated in FIG. 1). It will also be appreciated that, while the term "expansion zone" has been used for convenience in describing this zone, this terminology merely signifies that this zone exhibits at least some increase in lateral extent along the downstream direction of the zone. As mentioned above, a decrease in tertiary extent may occur in the downstream direction of the zone, such that the cross sectional area of the zone outlet may be smaller than that of the zone inlet. Thus, the characterizing of this zone as an expansion zone refers merely to lateral expansion; it does not imply that any overall expansion of the cross sectional area in the downstream direction must necessarily occur, and it does not imply that expansion of (e.g., reduction in density of) the fluid as it flows downstream in the zone must necessarily occur.

Apparatus 1 further comprises an expanded zone 30 that is fluidly connected to expansion zone 20 in order to receive preheated fluid therefrom. The exemplary expanded zone 30 depicted in FIGS. 1 and 2 comprises first major wall 31, second major wall 32, and first and second minor walls 33 and 34. Expansion zone 20 comprises a downstream axis as described above and at any point along the downstream axis will comprise a lateral extent measureable along a lateral axis, and a tertiary extent measureable along a tertiary axis.

Expanded zone 30 comprises inlet 35 through which preheated fluid is received from expansion zone 20. Inlet 35 comprises a lateral extent and a tertiary extent and a cross sectional area. In some embodiments, the lateral and tertiary extent of inlet 35 of expanded zone 30 are substantially equal to (e.g., are not more than 5% different from) those of outlet 26 of expansion zone 20. In some embodiments, the lateral and tertiary extents of expanded zone 30 may be substantially constant (e.g., do not vary by more than 5%) along the downstream axis of expanded zone 30. In other embodiments, either the lateral or tertiary extent of expanded zone 30 may change along the downstream axis of expanded zone 30 (for example, downstream outlet 60 of expanded zone 30 may be narrower in either tertiary or lateral extent, in comparison to inlet 35).

The aspect ratio (lateral extent to tertiary extent) of expanded zone 30 may be at least about 25:1, at least about 35:1, or at least about 45:1. The aspect ratio may be substantially constant downstream through expanded zone 30. Or, it may vary somewhat, in which case separate aspect ratios may be defined at inlet 35 and outlet 60, either of which may comprise an aspect ratio of at least about 25:1, at least about 35:1, or at least about 45:1. While expanded zone 30 (and inlet 35 and outlet 60 thereof, and also outlet 26 of expansion zone 20) may be characterized as having a high aspect ratio this does not necessarily imply a strictly rectangular configuration (e.g., with strictly straight major and minor walls). That is, generally oval or elliptical designs are within the scope of the disclosures herein.

Expanded zone 30 may comprise a first elbow 37 and/or a second elbow 38. It will be understood that the provision of such elbows, and other aspects of the design of apparatus 1, may be in response to specific spatial and geometric constraints present in the installation of apparatus 1 in a particular environment. More, or fewer, elbows, bends, etc. can be used, the downstream extent (length) of expanded zone may be varied, etc., as may be suitable for a particular circumstance. Often, the lateral and tertiary extents of expanded zone 30 may remain generally constant through such elbows, but this may not be necessary in all cases.

Expanded zone 30 comprises a plurality of (e.g., at least two) secondary heaters 40 that are used for fine control of the temperature of the fluid and are referred to for convenience herein as trim heaters. Trim heaters 40 can serve to augment preheater 11, e.g. to provide a more precisely controlled temperature of the fluid, particularly across the lateral axis of expanded zone 30. Preheated fluid after having been exposed to (e.g., by passing in contact with or in close proximity to) a trim heater 40 will be referred to for convenience as trim-heated fluid (regardless of whether or not a particular trim heater of the plurality of trim heaters is actually delivering heat at the particular moment that a particular parcel of preheated fluid is exposed to the trim heater, as is discussed in further detail later herein).

Trim heaters 40 are individually controllable; i.e., each trim heater 40 can be supplied with power, and/or brought to a particular temperature, independently of other trim heaters 40. Trim heaters 40 collectively extend across at least a portion of the lateral extent of expanded zone 30. While in some circumstances it may be desired to provide trim heaters 40 along only a portion of the lateral extent of expanded zone 30, in some circumstances it may be desired that trim heaters 40 collectively extend across the entire lateral extent of expanded zone 30. It may be convenient to provide the plurality of trim heaters 40 aligned generally linearly at a particular location along the downstream axis of expanded zone 30 (as in the exemplary embodiment of FIG. 4) although it is also possible that they could be staggered along the downstream axis of expanded zone 30.

Trim heaters 40 may comprise any suitable heater which may heat the fluid by any suitable method, including those discussed above with regard to preheater 11. In some embodiments, it may be advantageous that trim heaters 40 function by direct heating (e.g., by the passing of an electric current through the heater) rather than by using a heat exchange fluid. In some embodiments it may be advantageous that trim heaters 40 are low-pressure drop heaters (e.g., that may protrude into the fluid flowstream within expanded zone 30, but that present a relatively small resistance to gaseous fluid flow). A particularly convenient type of trim heater is a low pressure drop, electric heater comprising a rod comprised of a resistive conductor within a metal sheath. In specific embodiments, the rod may be formed into a cylindrical open coil of the general design shown in FIGS. 4 and 5, although other geometric designs are possible. Such electrical resistance heaters may be obtained e.g. from Watlow Co., Hannibal, Mo., under the trade designation WATROD Tubular Heaters. Such trim heaters may be operated in an on/off mode (in which they can either be turned off, or activated at a constant power). However, it may be preferable that trim heaters 40 be variably controllable, to enhance the fine control of the temperature of the trim-heated fluid.

Figure 4:
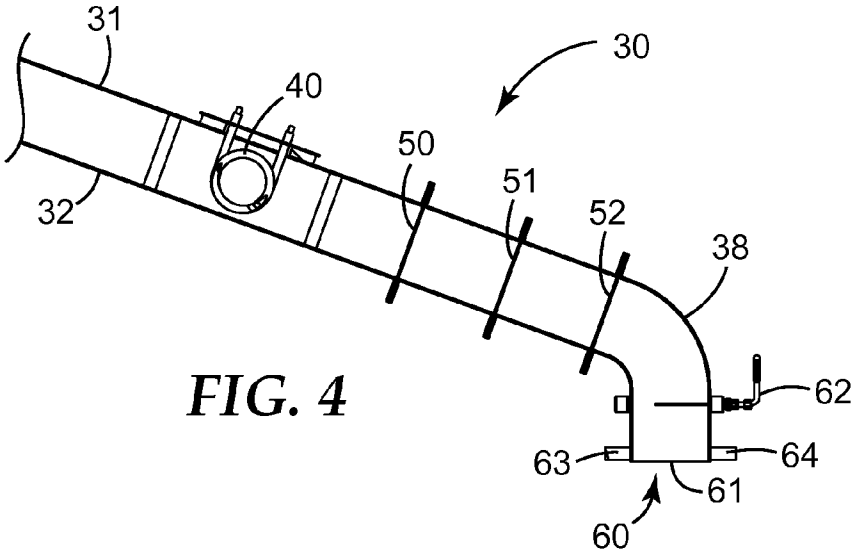
FIG. 4 is a side cross sectional view of a portion of the exemplary apparatus of FIG. 1, taken along the line marked 4-4 in FIG. 1.
Figure 5:
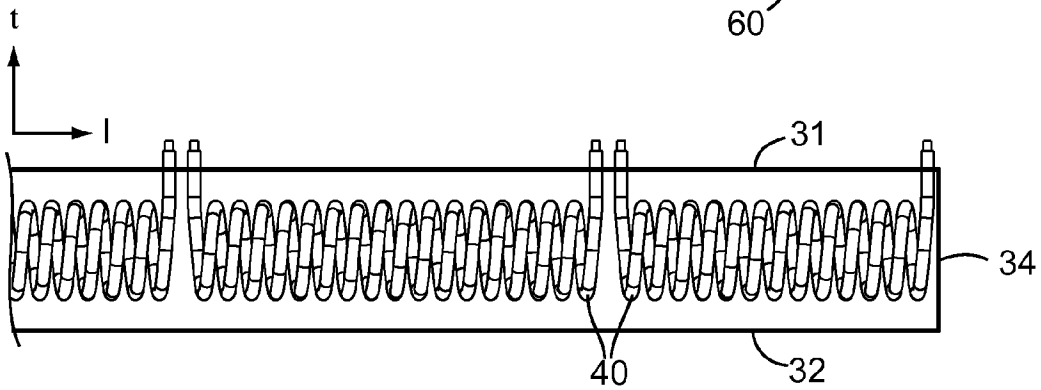
FIG. 5 is a front cross sectional view of a portion of the exemplary apparatus of FIG. 1, taken along the line marked 5-5 in FIG. 1.

Trim heaters 40 may be spaced across the lateral extent of expanded zone 30 e.g. with the long axis of each trim heater 40 aligned generally with the lateral axis of expanded zone 30. (In this context, the term spaced does not imply that there is significant lateral space between each trim heater and/or between minor walls 32 and 34 and the trim heater closest to that wall; rather, the trim heaters may be arranged so that such spaces are minimal, e.g. less than 0.5 inch [1.3 cm]). For example, a suitable number of cylindrical open-coil trim heaters may be provided in parallel (i.e., aligned end-to-end along their long axes) across the lateral extent of expanded zone 30 at a particular point along the downstream axis of expanded zone 30. Two trim heaters 40, the rightmost being the closest trim heater to wall 34 of expanded zone 30, are shown in such a configuration in FIG. 5. For optimum performance, it may be helpful to position each trim heater approximately centered along the tertiary axis of expanded zone 30 (i.e., approximately centered between major walls 31 and 32, as shown in FIGS. 4 and 5). In some embodiments, one or more additional trim heaters may be placed in downstream series with an upstream trim heater (that is, placed downstream of the upstream trim heater and at least partially aligned with it along the lateral axis of expanded zone 30).

While the plurality of trim heaters 40 are described above in the exemplary embodiment of trim heaters that are physically separate units (e.g., as shown in exemplary manner in FIG. 5), in the context used herein, a plurality of trim heaters also encompasses a single physical unit that comprises at least two individually controllable sections (i.e., sections which can be supplied with power, and brought to a particular temperature, independently of each other) along the lateral extent of the single physical unit. That is, it is not required that the at least two individually controllable sections are not physically connected to each other.

Expanded zone 30 further comprises at least one fluid flow-distribution sheet 50 that extends across at least a portion of the lateral extent of expanded zone 30. In some embodiments, the at least one fluid flow-distribution sheet 50 extends substantially across the lateral extent and substantially across the tertiary extent of expanded zone 30, e.g. so that at least 90% of the fluid passing through expanded zone 30 passes through openings of the fluid flow-distribution sheet 50. (Fluid flow-distribution sheet 50 may comprise a single continuous sheet, may comprise several pieces abutted together to collectively provide fluid flow-distribution sheet 50, etc).

Fluid flow-distribution sheet 50 may redistribute the flow of preheated fluid, and/or trim-heated fluid, so as to provide a more uniform distribution of flow velocity and/or temperature, particularly across the lateral extent of expanded zone 30. Specifically, fluid flow-distribution sheet 50 may compensate for flow and/or temperature non-uniformities that may occur due to the large lateral expansion factor of expansion zone 20 (since such a large lateral expansion factor may cause boundary layer separation, vortex shedding, generation of large scale eddies, and the like).

Fluid flow-distribution sheet 50 may be placed at any desired location along the downstream axis of expanded zone 30. While it might be expected that best performance might be obtained by providing a fluid flow-distribution sheet 50 upstream from trim heaters 40 (e.g., so that a more uniform flow velocity and temperature distribution might be obtained upstream of the trim heaters, so that the trim heaters can more easily achieve the desired fine control of the fluid temperature), it has surprisingly been found that placing fluid flow-distribution sheet 50 downstream of trim heaters 40 can provide substantial benefits. That is, trim heaters 40 which may be provided upstream of any fluid flow-distribution sheet 50 (e.g., at a location in which large-scale flow and/or temperature non-uniformities might be expected to be present) may provide sufficient fine control of temperature that, in concert with a downstream fluid flow-distribution sheet 50, the advantageous results disclosed herein may be obtained.

Fluid flow-distribution sheet 50 may comprise any sheet material that comprises suitable openings that permit flow of gaseous fluid therethrough. Such a sheet material may be chosen from e.g. mesh screens (whether of a regular pattern such as a woven screen, or of irregular pattern such as an expanded-metal or sintered metal mesh). Such a sheet material may also be chosen from perforated sheeting, e.g. perforated metal sheeting. Fluid flow-distribution sheet 50 may be distinguished from flow-alignment elements (e.g., such as honeycombs with the long axes of the flow channels oriented in the direction of flow of the fluid) that may not provide the desired redistribution or mixing of the fluid flow.

In some embodiments, the fluid flow-distribution sheet 50 may be a low-pressure-drop fluid flow-distribution sheet, defined herein as a fluid flow-distribution sheet with a percent open area of at least about 25% and an average opening size of at least 0.06 inch (1.5 mm). Such parameters may be measured straightforwardly e.g. for perforated sheeting (with the average opening size being the diameter in the case of generally circular openings, or the equivalent diameter in the case of noncircular openings). It has surprisingly been found that such a low-pressure-drop fluid flow-distribution sheet may achieve satisfactory uniformity of the fluid flow and/or temperature across the lateral extent of expanded zone 30, with minimal pressure drop. In various embodiments, low-pressure-drop fluid flow-distribution sheet 50 may comprise a perforated sheet in which the average opening size is at least about 0.08 inch (2.0 mm), at least about 0.10 inch (2.5 mm), or at least about 0.12 inch (3.0 mm). In further embodiments, the average opening size may be at most about 0.4 inches (10 mm), at most about 0.3 inches (7.6 mm), or at most about 0.2 inches (5.1 mm). In various embodiments, the percent open area may be at least about 30%, at least about 35%, or at least about 40%. In further embodiments, the percent open area may be at most about 75%, at most about 60%, at most about 50%, or at most about 45%.

Fluid flow-distribution sheet 50 may be placed generally normal to the direction of overall fluid flow (e.g., as shown in FIG. 4). If desired, fluid flow-distribution sheet 50 may be angled somewhat across the lateral and/or tertiary extent of expanded zone 30. In some embodiments, more than one fluid flow-distribution sheet 50, e.g. low-pressure-drop fluid flow-distribution sheet 50, may be provided in downstream series (i.e., one after the other, in spaced relation downstream) in expanded zone 30. For example, the exemplary embodiment of FIG. 4 depicts first fluid flow-distribution sheet 50, second fluid flow-distribution sheet 51, and third fluid flow-distribution sheet 52, in downstream series. It has been found that the use of multiple fluid flow-distribution sheets 50 in this manner may provide enhanced uniformity of fluid flow and/or temperature across the lateral extent of expanded zone 30.

In some embodiments, series-downstream fluid flow-distribution sheets 50 may be spaced apart along the downstream axis of expanded zone 30 by a distance that is at least as large as the tertiary extent of expanded zone 30 (that is, the distance between walls 31 and 32). In some embodiments, the farthest-downstream fluid flow-distribution sheet (sheet 52 in the case of FIG. 4) may be recessed upstream from outlet 60 a distance that is at least as large as the tertiary extent of expanded zone 30. Since the fluid flow immediately downstream of a fluid flow-distribution sheet 50 may comprise jets emitting from the perforations, interspersed with stagnant regions adjacent the solid portions of the sheet, it may be advantageous to recess the farthest-downstream fluid flow-distribution sheet in this manner to ensure that the fluid flow is sufficiently uniform by the time the fluid reaches outlet 60.

Outlet 60 is provided at a terminal end of expanded zone 30, as shown in exemplary manner in FIG. 4. Trim-heated fluid can be delivered through outlet 60 for any suitable purpose (for example, to be impinged on and/or passed through a substrate as discussed in detail later herein). For convenience of description, working face 61 of outlet 60 is defined as the plane through which trim-heated fluid exits outlet 60 and that is bounded by components (e.g., terminal ends of walls) of outlet 60. For optimum control of flow velocity and/or temperature of the trim-heated fluid, the lateral and tertiary extent of working face 61 of outlet 60 may be generally similar to (e.g., within 5% of), or substantially identical to, the lateral and tertiary extent of expanded zone 30. Working face 61 of outlet 60 may be characterized in terms of an aspect ratio (the ratio of the lateral extent of working face 61 to the tertiary extent of working face 61). In various embodiments, working face 61 may comprise an aspect ratio of at least 25:1, 35:1, or 45:1.

In some embodiments, expanded zone 30 may comprise elbow 38 that is proximate outlet 60, as shown in the exemplary embodiment of FIG. 4. As mentioned previously, the presence or absence of one or more elbows in apparatus 1 may be chosen, or dictated, by the particular spatial and geometric constraints of the equipment (e.g., substrate forming or processing equipment) with which apparatus 1 is to be used. If an elbow 38 is used that is proximate outlet 60, in some embodiments a generally straight section of expanded zone 30 may be provided between elbow 38 and working face 61 of outlet 60 that is at least as long as the tertiary extent of expanded zone 30. In some embodiments, elbow 38 will comprise a radius of curvature that is at least as large as the tertiary extent of expanded zone 30.

In some embodiments, a plurality of temperature sensors 62 may be provided in expanded zone 30, proximate outlet 60 and spaced across the lateral extent of expanded zone 30. Temperature sensors 62 may detect any variations in the temperature of the trim-heated fluid across the lateral extent of expanded zone 30 and thus may allow trim heaters 40 to be individually controlled so as to achieve the herein-disclosed fine control of the temperature of the trim-heated fluid, across the lateral extent of expanded zone 30. Thus, in this manner, trim-heated fluid may be delivered from outlet 60 that has a very uniform temperature profile across the lateral extent of working face 61 of outlet 60. (Alternatively, the power delivered to each trim heater may be controlled so that the temperature profile varies over the lateral extent of the outlet, if this is desired.) In some embodiments, the plurality of temperature sensors 62 are provided with each temperature sensor being generally downstream from (i.e., generally laterally aligned with) a particular trim heater 40, so that the temperature reading from a particular temperature sensor can be used to control the operation of a particular trim heater 40. The temperature reported by the various temperature sensors can be monitored by an operator who can adjust the power supplied to the individual trim heaters accordingly. However, it may often be convenient that the data provided by the temperature sensors be supplied to a process control mechanism that automatically controls the power inputted to the trim heaters based on the data provided by the temperature sensors.

Temperature sensors 62 may all be the same, or some may differ from each other. In some embodiments, temperature sensors 62 may each be a thermocouple, e.g. an open junction thermocouple. In various embodiments, J-type thermocouples or E-type thermocouples may be conveniently used. The temperature-sensitive portion (e.g., tip end) of each temperature sensor 62 may be placed so that it protrudes into the stream of trim-heated fluid, without causing unacceptable pressure drop. It has been found advantageous to position temperature sensors 62 slightly upstream from working face 61 (e.g., a distance that is at least 30% of the tertiary extent of expanded zone 30), as shown in FIG. 4. In particular embodiments in which elbow 38 is present, it has been found advantageous to position the temperature-sensitive tip of temperature sensors 62 somewhat toward the major surface of expanded zone 30 that is a continuation of the radially-outermost surface of expanded zone 30 at elbow 38 (thus, for example, in the exemplary embodiment of FIG. 4, the tip of temperature sensor 62 is displaced somewhat toward major wall 31).

Outlet 60 may comprise flanges 63 and 64 that flank working face 61 on both tertiary sides and that may extend substantially along the entire lateral extent of working face 61. Such flanges may advantageously provide mechanical strength and stability to outlet 61, so as to minimize vibration and the like. In various embodiments, flange 63 and 64 may be about ½ to 2 inches in width (along the tertiary axis of working face 61 of outlet 60). When used to deliver heated fluid onto a substrate, outlet 60 may be positioned so that working face 61 is any convenient distance from the substrate, e.g. from about 0.5 inch (1.3 cm) to about 5 inches (12.7 cm). In particular embodiments, working face 61 may be from about 1.0 inch (2.5 cm) to about 2.0 inches (5.1 cm) from the substrate.

The walls (e.g., major and minor walls) that at least partly define the various zones (preheat zone 10, expansion zone 20, expanded zone 30) of apparatus 1 may be made e.g. of sheet metal, such as sheet steel, as is common practice. The various zones may be conveniently provided as separate sections that are then attached together, e.g. with the assistance of externally-protruding flanges as are visible in FIG. 1. However, such sectional assembly and/or externally-protruding flanges are not required (and are omitted in FIGS. 2 and 3. If desired, thermal insulation 39 (e.g., a fibrous blanket or the like) may be provided in any or all of preheat zone 10, expansion zone 20, and/or expanded zone 30. It may be particularly advantageous to provide such insulation in at least a portion of expanded zone 30 (e.g., as shown in exemplary manner in FIGS. 1 and 2) so as to maintain a finely-controlled fluid temperature achieved by the methods disclosed herein. Such insulation may extend downstream all the way to outlet 60 if desired. At whatever downstream point of a zone that insulation 39 is provided, it may surround the zone (for example, over a particular downstream extent of expanded zone 30, insulation 39 may be provided that is outwardly adjacent, and optionally in contact with, walls 31, 32, 33 and 34). If desired, expanded zone 30 may comprise a hinge 68 located at any suitable position so that outlet 60 may be more easily maneuvered and positioned (e.g., a laterally-oriented hinge which allows outlet 60 to be moved toward and/or away from a substrate). In some embodiments, apparatus 1 may not comprise any flow-altering element of any type (whether the particular fluid flow-distribution sheet 50 as described herein, or any other type of fluid flow-distribution or flow control element) in expansion zone 20. In some embodiments, apparatus 1 may not comprise any flow modifier or turbulence-inducing apparatus in between working face 61 of outlet 60 and a substrate upon which the heated fluid is impinged. In some embodiments, expanded zone 30 may not comprise any flow-alignment members (i.e., vanes or dividers oriented generally downstream and serving to divide the expanded zone into lateral sections). The heated (e.g., pre-heated and trim-heated) fluid can be any gaseous fluid, with air often being most convenient to use.

As has already been noted, the design of apparatus 1 can be varied as needed for a particular purpose and/or to fit a particular environment. For example, the dimensions, angles, etc., of the various zones can be selected as needed. Furthermore, apparatus 1 need not be limited to the specific number of zones as disclosed above. For example, expanded zone 30 might in some cases be followed (downstream) by another expansion zone (e.g. a secondary expansion zone), which itself might be followed by another expanded zone (e.g., a secondary expanded zone), which may or may not contain trim heaters and/or fluid flow-distribution sheets.

Those of ordinary skill will appreciate that apparatus 1 and methods of using have been discussed above with reference to an exemplary configuration (e.g., as shown in FIGS. 1-3) in which preheat zone 10, expansion zone 20, and expanded zone 30, have discrete and unambiguously identifiable boundaries therebetween. However, it will be appreciated that this may not necessarily be the case in every design. For example, preheat zone 10 might comprise a configuration in which the lateral extent of preheat zone 10 increases along the downstream axis of at least a portion of preheat zone 10 (e.g., a portion proximate to expansion zone 20), such that it may not possible to state with certainty exactly where preheat zone 10 ends and expansion zone 20 begins. That is, the designation of where inlet 25 of expansion zone 20 is located along the downstream axis of preheat zone 10 and expansion zone 20, may be somewhat arbitrary. Likewise, expanded zone 30 might comprise a configuration in which the lateral extent of expanded zone 30 increases along the downstream axis of at least a portion of expanded zone 30 (e.g. a portion proximate to expansion zone 20), such that it may not be not possible to state with certainty exactly where expansion zone 20 ends and expanded zone 30 begins. That is, the designation of where outlet 26 of expansion zone 20, and inlet 35 of expanded zone 30, are located along the downstream axis of expansion zone 20 and expanded zone 30, may be somewhat arbitrary. All such possible variations are included within the scope of the disclosures herein. For example, one such variation might comprise an apparatus in which the lateral extent of the apparatus continuously expands along the downstream axis of the apparatus, with the exact locations of the boundaries between the preheat zone, the expansion zone, and the expanded zone thus being somewhat arbitrary.

Figure 6:
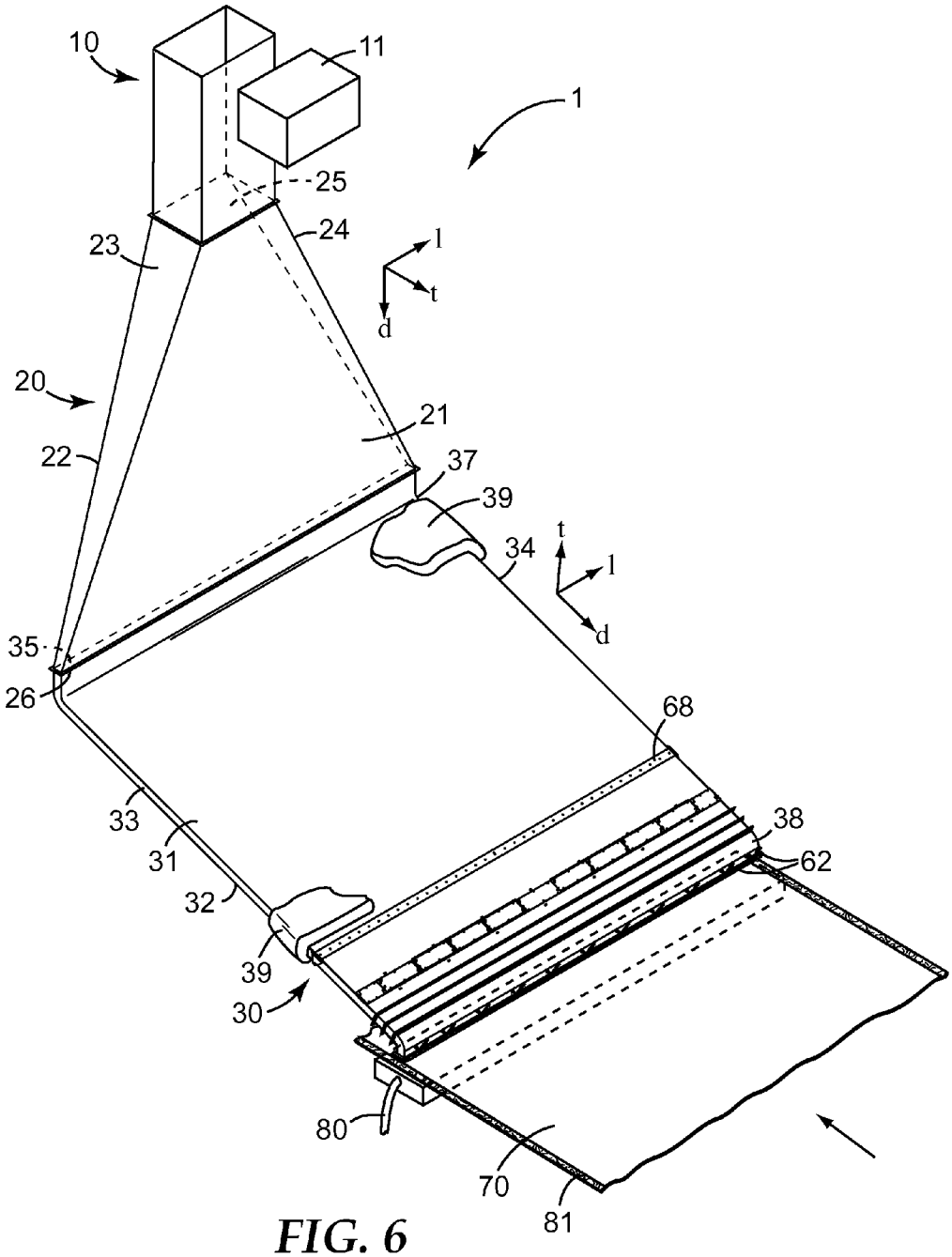
FIG. 6 is a side perspective view of an exemplary apparatus as disclosed herein, further comprising a fluid-suction apparatus.

Apparatus 1 as described herein may be used for any application in which it is desired to deliver trim-heated fluid, e.g. onto a substrate. In some embodiments, the substrate may be a moving substrate 70, as pictured in exemplary manner in FIG. 6. In particular embodiments, moving substrate 70 may be a fibrous web made of fibers that are bonded together at least to a certain extent (e.g., melt-blown fibers). In other embodiments, moving substrate 70 may be a fibrous mat comprising fibers that are not bonded together (e.g., organic polymeric melt-spun fibers, as made e.g. in a process such as described in U.S. Patent Application Publication 2008/0038976 to Berrigan et. al., incorporated herein by reference). In such cases, apparatus 1 may be used to pass trim-heated fluid through the fibrous mat in order to promote bonding (e.g., melt-bonding) of at least some of the fibers to each other (such a process will be referred to herein as through-air bonding). Apparatus 1 may advantageously allow such through-air bonding to be performed in a uniform manner even on very wide moving substrates (e.g., fibrous mats of over about 70 inches [178 cm], 90 inches [229 cm], or 110 inches [279 cm] in width, and even up to approximately 132 inches [335 cm] in width or more). Apparatus 1 may be particularly useful when the fibrous mat is a monocomponent mat comprised of monocomponent organic polymeric fibers (e.g., polypropylene). In such monocomponent mats, there may be a much narrower window of temperatures over which through-air bonding can be successfully performed than for fibrous mats comprising e.g. multicomponent (e.g., bicomponent) fibers. That is, bicomponent fibers often comprise a portion (e.g., a core) of a relatively high melting material, and a portion (e.g., a sheath) of a relatively low melting material. Thus, there may be a relatively wide temperature range in which the sheath portion is meltable so as to bond the fibers to each other, while the core portion remains unmelted and provides mechanical stability. In contrast, monocomponent fibers may have a narrow temperature window for through-air bonding, below which no bonding may occur, and above which unacceptably high deterioration of fiber properties may occur. Thus, the fine temperature control enabled by the apparatus and methods disclosed herein may be particularly suitable for the through-air bonding of monocomponent fibrous mats. In the particular application of through-air bonding of monocomponent polypropylene fibers, it may be desired to deliver trim-heated fluid at a temperature in the general range of 130-155 degrees C.

In various embodiments, preheater 11 of preheat zone 10 may be used to preheat fluid to a nominal temperature that is slightly lower than the target temperature of the trim-heated fluid, with trim heaters 40 used as necessary to bring the fluid to the final (target) temperature. In various embodiments, one or more trim heaters may additionally heat the preheated fluid by a temperature increment of no more than about 15 degrees C., of no more than about 7 degrees C., of no more than about 3 degrees C., or of no more than about 1 degrees C. Since the preheated air may exhibit variations in temperature, at any given time during the operation of apparatus 1 different trim heaters 40 may be operated at different power levels and thus may be heating the preheated fluid by different temperature increments. In certain instances (e.g., particularly when apparatus 1 has run for sufficiently long time to achieve generally steady-state operation), one or more of trim heaters 40 may only need to be used sporadically, or possibly not at all. Thus, use of the apparatus and methods disclosed herein may not necessarily require every trim heater 40 to be powered (delivering heat) at all times.

Trim-heated air may be delivered through working face 61 of outlet 60 at a linear velocity of, e.g., between about 400 feet (122 meters) per minute and about 3000 feet (912 meters) per minute. Particularly when used for purposes of through-air bonding of a fibrous mat, it may be advantageous to provide suction on the opposite side of the moving substrate (fibrous mat), in order to capture and remove the trim-heated fluid after it has passed through the moving substrate. This may be performed by the use of suction apparatus 80 as shown in exemplary manner in FIG. 6. Moving substrate 70 may be carried e.g. on a porous belt 81 (e.g., mesh or the like) with suction apparatus 80 placed underneath. Suction apparatus 80 may comprise a lateral extent that is at least as wide as the lateral width of moving substrate 70 and that may be similar to, equal to, or greater than, the lateral extent of working face 61 of outlet 60. Suction apparatus 80 may be designed to capture and remove a portion (e.g., at least about 80 volume %), or generally all, of the trim-heated fluid that is passed through moving substrate 70. In some embodiments, suction apparatus may be operated to capture and remove more fluid than is delivered through outlet 61, in which case some portion of ambient air may be drawn through moving substrate 70 and removed by suction apparatus 80.

If apparatus 1 is to be used in combination with a melt-spinning apparatus, other suction apparatus or zones may also be used. For example, a first suction apparatus may be used to aid in the collection of the spun fibers as a fibrous mat, which is then conveyed to a second suction apparatus which performs to remove trim-heated air passed through the mat in the course of through-air bonding, as described herein. If desired, one or more additional suction apparatus may be used as desired to provide heat treatment, quenching, etc., of the through-air bonded spun-bonded fibrous web. All of these suction apparatus may be different apparatus (e.g., operated at different conditions); alternatively, two or more of the suction apparatus may be zones of a single suction apparatus of sufficient extent (e.g., down the direction of movement of moving substrate 70) to perform the multiple functions. The fluid that is collected and removed by any or all of such suction apparatus may be recirculated to the inlet of preheat zone 10 (e.g., by the afore-mentioned blower fan), if desired.

While being described herein primarily in the context of providing trim-heated fluid that may be very uniform across the lateral extent of the outlet as it exits the outlet of the apparatus (and, e.g., as it is impinged onto a substrate), the apparatus and methods disclosed herein allow very precise temperature control that may be used to other ends. For example, it may be possible to vary the temperature of the trim-heated air across the lateral extent of the outlet, e.g. in order to produce substrates with downweb-oriented stripes that have received different thermal exposures. In addition, in some instances it may be helpful to adjust the operation of the trim heaters (e.g., the power delivered thereto) based on observation of the properties of the heated substrate (e.g. the lateral variation of certain properties of the substrate), rather than solely relying on the temperature readings provided by the temperature sensors. Furthermore, while the operation of apparatus 1 has been described above primarily with regard to its use for delivering heated fluid for purposes of bonding a fibrous mat (substrate), many other uses are possible, and may be applied to any suitable substrate, article, or entity, moving or unmoving. For example, apparatus 1 may be used for delivering heated fluid for purposes of drying, annealing or any other type of heat treatment, promoting a chemical reaction, etc.

This application is a divisional of U.S. patent application Ser. No. 12/948,094, filed 17 Nov. 2010, now allowed, the disclosure of which is incorporated by reference herein in its entirety.

List of Exemplary Embodiments

Embodiment 1 is an apparatus for handling, heating and delivering a fluid, comprising: a preheat zone comprising a preheater; an expansion zone fluidly connected to the preheat zone; an expanded zone fluidly connected to the expansion zone and comprising a downstream axis and a lateral extent and a tertiary extent, the expanded zone further comprising: a plurality of trim heaters collectively extending across at least a portion of the lateral extent of the expanded zone, at least one fluid flow-distribution sheet, and, an outlet. Embodiment 2 is the apparatus of embodiment 1 wherein the plurality of trim heaters collectively extend across the lateral extent of the expanded zone. Embodiment 3 is the apparatus of any of embodiments 1-2 wherein the trim heaters comprise electrical resistance heaters. Embodiment 4 is the apparatus of any of embodiments 1-3 wherein the preheater comprises a heat exchanger configured to heat the fluid by exchanging thermal energy to the fluid from a preheating fluid.

Embodiment 5 is the apparatus any of embodiments 1-4 wherein the at least one fluid flow-distribution sheet is positioned downstream of the plurality of trim heaters. Embodiment 6 is the apparatus any of embodiments 1-5 wherein the fluid flow-distribution sheet comprises a perforated sheet with the perforations providing a percent open area of from about 30% to about 70% and having an average size of from about 0.06 inch (1.5 mm) to about 0.40 inch (10 mm). Embodiment 7 is the apparatus of any of embodiments 1-6 comprising at least two fluid flow-distribution sheets arranged in series along the downstream axis of the expanded zone. Embodiment 8 is the apparatus of any of embodiments 1-7 comprising at least three fluid flow-distribution sheets arranged in series along the downstream axis of the expanded zone. Embodiment 9 is the apparatus of embodiment 8 wherein the at least three fluid flow-distribution sheets are spaced apart along the downstream axis of the expanded zone by distances equal to or greater than the tertiary extent of the expanded zone.

Embodiment 10 is the apparatus of any of embodiments 1-9 wherein the outlet is spaced downstream from the fluid flow-distribution sheet that is closest to the outlet, by a distance that is greater than the tertiary extent of the expanded zone. Embodiment 11 is the apparatus of any of embodiments 1-10 wherein the outlet comprises a working face and wherein the expanded zone comprises a plurality of temperature sensors spaced across the lateral extent of the expanded zone and positioned a distance upstream from the working face of the outlet that is greater than about 30% of the tertiary extent of the expanded zone, with a temperature-sensitive tip of each temperature sensor protruding into the fluid.

Embodiment 12 is the apparatus of any of embodiments 1-11 wherein the expansion zone comprises a lateral expansion factor of at least 3.5 and a tertiary contraction factor of at least 4.0. Embodiment 13 is the apparatus of any of embodiments 1-12 wherein the expansion zone comprises a lateral expansion factor of at least 5.0 and a tertiary contraction factor of at least 5.0. Embodiment 14 is the apparatus of any of embodiments 1-13 wherein the expansion zone comprises a lateral expansion angle of at least 15 degrees.

Embodiment 15 is the apparatus of any of embodiments 1-14 wherein at least the expanded zone comprises thermal insulation that surrounds at least a portion of the expanded zone. Embodiment 16 is the apparatus of any of embodiments 1-15 wherein the outlet comprises a working face with an aspect ratio of at least 35:1 Embodiment 17 is the apparatus of any of embodiments 1-16 wherein the apparatus further comprises a fluid-suction apparatus configured to be placed on the on the opposite side of a fluid-permeable, moving substrate from the outlet, wherein the fluid-suction apparatus has a lateral width at least as wide as the lateral width of the substrate. Embodiment 18 is the apparatus of any of embodiments 1-17 wherein the expanded zone comprises a laterally-oriented hinge.

Embodiment 19 is a method of passing a heated fluid through a moving, fluid-permeable substrate, comprising: preheating a fluid; passing the preheated fluid through an expansion zone; passing the preheated fluid through an expanded zone, exposing at least a portion of the preheated fluid to at least one of a plurality of trim heaters within the expanded zone, passing at least a portion of the preheated fluid through at least one fluid flow-distribution sheet within the expanded zone; and, passing the preheated fluid through an outlet of the expanded zone onto the moving, fluid-permeable substrate and passing it through the substrate; and, capturing and removing at least a portion of the fluid passed through the substrate, by a fluid-suction apparatus located on the opposite side of the substrate from the outlet.

Embodiment 20 is the method of embodiment 19 wherein the moving, fluid-permeable substrate is a monocomponent melt-spun fibrous mat comprising monocomponent organic polymeric fibers. Embodiment 21 is the method of any of embodiments 19-20 wherein the expanded zone comprises a plurality of temperature sensors downstream from the trim heaters, and wherein the fluid temperature readings monitored by the temperature sensors are used to control the power supplied to the trim heaters. Embodiment 22 is the method of any of embodiments 19-21 wherein the trim heaters collectively extend across a lateral extent of the expanded zone, wherein the temperature sensors are spaced across the lateral extent of the expanded zone, and wherein the power supplied to each trim heater is controlled based on the fluid temperature reported by a temperature sensor that is generally downstream of, and laterally aligned with, that trim heater. Embodiment 23 is the method of any of embodiments 19-22 wherein the trim heaters additionally heat the preheated fluid by a temperature increment of less than about 3 degrees C. Embodiment 24 is the method of any of embodiments 19 to 23, wherein the method uses an apparatus comprising any of embodiments 1-18.

Embodiment 25 is a method of delivering a heated fluid, comprising: preheating a fluid; passing the preheated fluid through an expansion zone; passing the preheated fluid through an expanded zone, exposing at least a portion of the preheated fluid to at least one of a plurality of trim heaters within the expanded zone, passing at least a portion of the preheated fluid through at least one fluid flow-distribution sheet within the expanded zone; and, delivering the preheated fluid through an outlet of the expanded zone. Embodiment 26 is the method of embodiment 25, wherein the method uses an apparatus comprising any of embodiments 1-18.

Example

A heated-air delivery apparatus was constructed of the general design shown in FIGS. 1-6. The apparatus comprised a preheat zone with a lateral extent of 30 inches and tertiary extent of 20 inches (as defined by sheet steel walls), and comprised a three-stage, steam-supplied heat exchanger preheater. The preheat zone contained an inlet that was fed with ambient air motivated by a conventional blower fan.

The outlet of the preheat zone was fluidly connected to the inlet of an expansion zone, with the inlet having a lateral extent of 30 inches (76 cm) and a tertiary extent of 20 inches (51 cm) and being aligned with the outlet of the preheat zone. Major and minor walls of the expansion zone were configured so that, over a downstream distance of approximately 125 inches (318 cm), the lateral extent expanded to about 146 inches (371 cm) and the tertiary extent contracted to about 3 inches (7.6 cm), as measured at the outlet of the expansion zone. This corresponded to a lateral expansion factor of approximately 4.9 and a lateral expansion angle of about 25 degrees, and to a tertiary contraction factor of approximately 6.7 and a tertiary contraction angle of about 8 degrees (all as defined previously herein).

The outlet of the expansion zone was fluidly coupled to an inlet of an expanded zone, which inlet was of the same lateral and tertiary dimensions as (and aligned with) the outlet of the expansion zone. The expanded zone comprised a downstream straight run of a few inches, followed by an elbow, followed by a straight run of approximately twelve feet (3.6 meter), followed by another elbow, followed by a straight run of a few inches, terminating in a flanged outlet, in similar manner as depicted in FIGS. 1 and 2. The major and minor walls were substantially parallel to each other over the entire downstream length of the expanded zone, so that the cross sectional area of the expanded zone did not change over the downstream length of the zone, and so that the outlet (specifically, the working face thereof) comprised a lateral extent of approximately 146 inches (371 cm) and a tertiary extent of approximately 3 inches (7.6 cm).

Trim heaters were provided at a point approximately 11 feet (3.3 meter) downstream from the first elbow of the expanded zone. The trim heaters each comprised an electrical-resistance heater made from a rod of diameter approximately 0.32 inches (0.8 cm), formed into a cylindrical open coil of diameter approximately 2.5 inches (6.4 cm) at a coil-spacing of approximately 1.6 coils per inch (2.5 cm), and were custom-fabricated by Watlow Co., Hannibal, Mo. The long axes of all of the cylindrical coils were co-aligned with the lateral axis of the expanded zone. Nine such heaters with a length of approximately 14 inches (36 cm) were used, collectively laterally flanked by two similar heaters (one on each lateral side) each about 8 inches (20 cm) in length. In this manner the trim heaters collectively extended over the entire approximately 146 inch (371 cm) lateral extent of the expanded zone. Each trim heater was centered within the approximately 3.0 inch (7.6 cm) tertiary extent of the expanded zone. Each trim heater comprised electrical connections so that it could be independently powered and controlled.

Three fluid flow-distribution perforated sheets were provided. The first was positioned approximately 5.9 inches (15 cm) downstream from the trim heaters (as measured from the downstream surface of the trim heaters), with the next two positioned at intervals of approximately 4.0 inches (10 cm) downstream of the preceding fluid flow-distribution sheet. All of the perforated sheets extended over essentially the entire tertiary and lateral extent of the expanded zone and were positioned generally normal to the air flow. Each perforated sheet comprised 14 gauge aluminum with approximately 0.125 inch (3.2 mm) diameter round holes, on approximately 0.1885 inch (4.8 mm) center to center spacings in a 60 degree hexagonal array (approximately 24.1 holes per square inch [6.5 square cm]), providing a percent open area of approximately 40.3.

The second elbow was positioned approximately 14.6 inches (37 cm) downstream from the trim heater (as measured from the downstream surface of the trim heaters to the upstream end of the elbow). The elbow comprised a radius of curvature of approximately 4.4 inches (11 cm). A straight run of approximately 3 inches (7.6 cm) was present from the downstream end of the elbow, to the outlet. The outlet comprised a working face that was flanked on each tertiary side by flanges that each extended approximately 1.0 inches (2.5 cm) along the tertiary axis of the outlet, and that extended along the entire lateral extent of the outlet. The flanges were comprised of metal and had a thickness (along the downstream axis of the outlet) of approximately 0.5 inches (1.3 cm).

J-type open junction thermocouples were attached to the radially innermost major surface of the straight-run that extended between the second elbow and the outlet (in similar manner as shown in FIG. 4, except that each thermocouple was mounted to the radially inner major surface instead of the radially outer major surface as shown in FIG. 4). Each thermocouple was positioned so that its temperature-sensitive tip end was located about 2.2 inches (5.6 cm) upstream from the working face of the outlet, and was located approximately 1 inch (2.5 cm) inward from the radially outermost surface (thus approximately 2 inches (5.1 cm) outward from the radially innermost surface). A plurality of thermocouples were provided, spaced along the lateral extent of the expanded zone, so as to provide measurement of the temperature of the air across the lateral extent of the expanded zone (at a point slightly upstream from the outlet, as stated above). The placement of the thermocouples and the spacing intervals therebetween (approximately 14 inches [36 cm] for most) was chosen so that each thermocouple was laterally aligned with (that is, aligned approximately near the lateral center of) one of the above-described trim heaters.

The apparatus was operated in conjunction with a melt fiber-spinning apparatus which was used to form a mat of monocomponent polypropylene fibers. The fiber-spinning apparatus (of the general type described in U.S. Patent Application Publication 2008/0038976 to Berrigan et. al.) was used to continuously deposit a fibrous mat of approximately 132 inches (335 cm) in lateral extent, onto a moving mesh carrier that was used to carry the fibrous mat underneath (with respect to conventional gravitational orientation) the above-described outlet with the long axis of the fibrous mat oriented perpendicular to the lateral axis of the outlet. A suction apparatus was provided underneath the carrier and was aligned with the above-described outlet, was similar in lateral extent to the outlet, and was approximately 6 inches (15 cm) in extent along the tertiary axis of the outlet (which axis was aligned with the direction of motion of the carrier and fibrous mat). In various cases the fibrous mat was carried underneath the outlet at speeds ranging from 90 to 130 feet (229 to 330 cm) per minute, which (in combination with the three-inch [7.6 cm] tertiary extent of the working face of the outlet) resulted in a residence time of the fibrous mat in the trim-heated air exiting the outlet of from approximately 0.1-0.2 seconds.

In various experiments, air was supplied to the apparatus by the above-described blower fan. The above-described preheater was fed with steam at, e.g., approximately 200 psi (14 bar), corresponding to a temperature in the range of 190-200 degrees C. This resulted in preheating the air to a nominal temperature that was often in the range of, e.g., 130-145 degrees C. In various experiments, typical linear velocities of trim-heated air emerging from the outlet were in the range of approximately 600 to about 2400 feet (182 to 730 meters) per minute. In many instances, a suction ratio of approximately 1:1 was used (that is, the suction apparatus removed generally all of the spent trim-heated air, but did not remove a substantial amount of ambient air as well). In other cases a slightly higher suction ratio (e.g., in the range of 1.1-1.5) was used. The above-described thermocouples were used to monitor the temperature of the trim-heated air as it approached the outlet, and the trim heaters were controlled by a process control system operating in view of the temperatures reported by the thermocouples. In various experiments, it was found that use of the preheater in combination with the trim heaters could provide trim-heated air that varied over time (at particular locations along the lateral extent of the outlet) by less than approximately plus or minus 0.5 degrees C., and in some cases by less than approximately plus or minus 0.1 degree. In various experiments (e.g., with the temperature of the trim-heated air being in the range of approximately 130-150 degrees C.), it was found that the entire lateral extent of fibrous webs comprising monocomponent polypropylene fibers could be generally uniformly through-air bonded using the apparatus and methods described above.

The tests and test results described above are intended solely to be illustrative, rather than predictive, and variations in the testing procedure can be expected to yield different results. All quantitative values in the Examples section are understood to be approximate in view of the commonly known tolerances involved in the procedures used. The foregoing detailed description and examples have been given for clarity of understanding only. No unnecessary limitations are to be understood therefrom.

It will be apparent to those skilled in the art that the specific exemplary structures, features, details, configurations, etc., that are disclosed herein can be modified and/or combined in numerous embodiments. All such variations and combinations are contemplated by the inventor as being within the bounds of the conceived invention. Thus, the scope of the present invention should not be limited to the specific illustrative structures described herein, but rather extends at least to the structures described by the language of the claims, and the equivalents of those structures. To the extent that there is a conflict or discrepancy between this specification and the disclosure in any document incorporated by reference herein, this specification will control.

What is claimed is:

1. An apparatus for handling, heating and delivering a gaseous fluid, comprising:

a preheat zone comprising a preheater;

an expansion zone fluidly connected to the preheat zone, the expansion zone being defined by first and second major walls and first and second minor walls, the expansion zone comprising an expansion zone inlet through which preheated fluid is received from the preheat zone and an expansion zone outlet through which preheated fluid exits the expansion zone, wherein the first and second major walls of the expansion zone and the first and second minor walls of the expansion zone are configured so that the expansion zone comprises a lateral expansion factor of at least 3.5 and a tertiary contraction factor of at least 4.0 and so that the expansion zone outlet exhibits an aspect ratio of at least 25:1;

an expanded zone with an expanded zone inlet that is fluidly connected to the expansion zone outlet of the expansion zone and through which preheated fluid is received from the expansion zone outlet of the expansion zone, the expanded zone comprising first and second major walls and first and second minor walls and a downstream axis and a lateral extent and a tertiary extent, wherein the first and second major walls of the expanded zone and the first and second minor walls of the expanded zone are configured so that the expanded zone inlet and the expanded zone outlet each comprise an aspect ratio of at least 25:1;

the expanded zone further comprising:

a plurality of trim heaters collectively extending across at least a portion of the lateral extent of the expanded zone, wherein at least one trim heater of the plurality of trim heaters comprises a long axis that is at least generally orthogonal to the downstream axis of the expanded zone, at least one fluid flow-distribution sheet positioned downstream of the plurality of trim heaters, and, an outlet;

and wherein the apparatus further comprises a gaseous fluid-suction apparatus configured to be placed on an opposite side of a fluid-permeable moving substrate from the outlet to remove trim-heated gaseous fluid that has passed through the moving substrate, wherein the gaseous fluid-suction apparatus has a lateral width at least as wide as the lateral width of the substrate.

2. The apparatus of claim 1 comprising at least three fluid flow-distribution sheets arranged in series along the downstream axis of the expanded zone.

3. The apparatus of claim 2 wherein the at least three fluid flow-distribution sheets are spaced apart along the downstream axis of the expanded zone by distances equal to or greater than the tertiary extent of the expanded zone.

4. The apparatus of claim 1 wherein the plurality of trim heaters collectively extend across the lateral extent of the expanded zone.

5. The apparatus of claim 1 wherein the trim heaters are electrical resistance heaters.

6. The apparatus of claim 1 wherein the trim heaters are individually controllable.

7. The apparatus of claim 1 wherein the preheater comprises a heat exchanger configured to heat the gaseous fluid by exchanging thermal energy to the gaseous fluid from a preheating fluid.

8. The apparatus of claim 1 wherein the fluid flow-distribution sheet comprises a perforated sheet with perforations having an average diameter or equivalent diameter of from 0.06 inch (1.5 mm) to 0.40 inch (10 mm).

9. The apparatus of claim 1 comprising at least two fluid flow-distribution sheets arranged in series along the downstream axis of the expanded zone.

10. The apparatus of claim 1 wherein the outlet is spaced downstream from the fluid flow-distribution sheet that is closest to the outlet, by a distance that is greater than the tertiary extent of the expanded zone.

11. The apparatus of claim 1 wherein the outlet comprises a working face and wherein the expanded zone comprises a plurality of temperature sensors spaced across the lateral extent of the expanded zone and positioned a distance upstream from the working face of the outlet that is greater than 30% of the tertiary extent of the expanded zone, with a temperature-sensitive tip of each temperature sensor protruding into the gaseous fluid.

12. The apparatus of claim 1 wherein the expansion zone comprises a lateral expansion factor of at least 5.0 and a tertiary contraction factor of at least 5.0.

13. The apparatus of claim 1 wherein the expansion zone comprises a lateral expansion angle of at least 15 degrees.

14. The apparatus of claim 1 wherein at least the expanded zone comprises thermal insulation that surrounds at least a portion of the expanded zone.

15. The apparatus of claim 1 wherein the outlet comprises a working face with an aspect ratio of at least 35:1.

16. The apparatus of claim 1 wherein the expanded zone comprises a laterally-oriented hinge.

17. The apparatus of claim 1 further comprising at least one fluid flow-distribution sheet located upstream of the plurality of trim heaters.

* * * * *